US007300565B2

(12) United States Patent
Hoek

(10) Patent No.: US 7,300,565 B2
(45) Date of Patent: Nov. 27, 2007

(54) PROCESS TO PREPARE A MICROCRYSTALLINE WAX AND A MIDDLE DISTILLATE FUEL

(75) Inventor: Arend Hoek, Amsterdam (NL)

(73) Assignee: Shell Oil Company, Houston, TX (US)

( * ) Notice: Subject to any disclaimer, the term of this patent is extended or adjusted under 35 U.S.C. 154(b) by 312 days.

(21) Appl. No.: 10/521,668

(22) PCT Filed: Jul. 17, 2003

(86) PCT No.: PCT/EP03/07785

§ 371 (c)(1),
(2), (4) Date: Jan. 18, 2005

(87) PCT Pub. No.: WO2004/009739

PCT Pub. Date: Jan. 29, 2004

(65) Prior Publication Data

US 2005/0247601 A1 Nov. 10, 2005

(30) Foreign Application Priority Data

Jul. 18, 2002 (EP) ..... 02077921

(51) Int. Cl.
*C10G 45/58* (2006.01)

(52) U.S. Cl. ..... 208/89; 208/58; 208/59; 208/97; 208/88; 208/74; 208/950

(58) Field of Classification Search ..... 208/89
See application file for complete search history.

(56) References Cited

U.S. PATENT DOCUMENTS

| | | | | |
|---|---|---|---|---|
| 2,603,589 | A | 7/1952 | Schaerer | 196/17 |
| 3,876,522 | A | 4/1975 | Campbell et al. | 208/58 |
| 3,965,018 | A | 6/1976 | Heilman et al. | 252/59 |
| 4,299,714 | A | 11/1981 | Sugiura et al. | 252/73 |
| 4,343,692 | A | 8/1982 | Winquist | 208/111 |
| 4,574,043 | A | 3/1986 | Chester et al. | 208/59 |
| 4,582,616 | A | 4/1986 | Kita et al. | 252/17 |
| 4,859,311 | A | 8/1989 | Miller | 208/89 |
| 4,919,788 | A | 4/1990 | Chen et al. | 208/59 |
| 4,943,672 | A | 7/1990 | Hamner et al. | 585/737 |
| 4,983,273 | A | 1/1991 | Kennedy et al. | 208/89 |
| 5,053,373 | A | 10/1991 | Zones | 502/64 |
| 5,059,299 | A | 10/1991 | Cody et al. | 208/27 |
| 5,135,638 | A | 8/1992 | Miller | 208/27 |
| 5,157,191 | A | 10/1992 | Bowes et al. | 585/533 |
| 5,252,527 | A | 10/1993 | Zones | 502/64 |
| 5,362,378 | A | 11/1994 | Borghard et al. | 208/138 |
| 5,370,818 | A | 12/1994 | Schleifstein | 252/186.25 |
| 5,372,703 | A | 12/1994 | Kamiya et al. | 208/58 |
| 5,447,621 | A | 9/1995 | Hunter | 208/58 |
| 5,456,820 | A | 10/1995 | Forbus, Jr. et al. | 208/111 |
| 5,693,598 | A | 12/1997 | Abraham et al. | 508/444 |
| 5,723,716 | A | 3/1998 | Brandes et al. | 585/734 |
| 5,770,542 | A | 6/1998 | Brandes et al. | 502/527 |
| 5,804,058 | A | 9/1998 | Grandvallet et al. | 208/171 |
| 5,856,365 | A | 1/1999 | Zennaro et al. | 518/715 |
| 5,935,417 | A | 8/1999 | Cody et al. | 208/87 |
| 6,059,955 | A | 5/2000 | Cody et al. | 208/18 |
| 6,060,437 | A | 5/2000 | Robson et al. | 508/371 |
| 6,090,989 | A | 7/2000 | Trewalla et al. | 585/13 |
| 6,103,099 | A | 8/2000 | Wittenbrink et al. | 208/27 |
| 6,165,949 | A | 12/2000 | Berlowitz et al. | 508/363 |
| 6,179,994 | B1 | 1/2001 | Clark et al. | 208/27 |
| 6,627,779 | B2 | 9/2003 | O'Rear | 585/302 |
| 6,642,189 | B2 | 11/2003 | Kurihara et al. | 508/364 |
| 2003/0118744 | A1 | 6/2003 | Li et al. | 427/512 |
| 2003/0119682 | A1 | 6/2003 | Saini et al. | 508/167 |
| 2004/0099571 | A1 | 5/2004 | Germaine et al. | 208/108 |
| 2004/0192979 | A1 | 9/2004 | Matthai et al. | 585/16 |

FOREIGN PATENT DOCUMENTS

| | | |
|---|---|---|
| AU | 698392 | 9/1995 |
| AU | 5785862 | 7/1998 |
| AU | 698392 | 10/1998 |
| EP | 113579 | 7/1984 |
| EP | 237655 | 9/1987 |
| EP | 323092 | 7/1989 |
| EP | 426223 | 5/1991 |
| EP | 0471524 | 2/1992 |
| EP | 0532118 | 3/1993 |
| EP | 0666894 | 8/1995 |
| EP | A0668342 | 8/1995 |

(Continued)

OTHER PUBLICATIONS

Shell Middle Distillate Synthesis, Internet Article.

(Continued)

*Primary Examiner*—Tam M. Nguyen

(57) ABSTRACT

The invention relates to a process to prepare a microcrystalline wax and a middle distillate fuel by (a) hydrocracking/hydroisomerizing a Fischer-Tropsch product, wherein the weight ratio of compounds having at least 60 or more carbon atoms and compounds having at least 30 carbon atoms in the Fischer-Tropsch product is at least 0.2 and wherein at least 30 wt % of compounds in the Fischer-Tropsch product have at least 30 carbon atoms, (b) performing one or more distillate separations on the effluent of step (a) to obtain a middle distillate fuel fraction and a microcrystalline wax having an initial boiling point of between 500 and 600° C.

9 Claims, No Drawings

FOREIGN PATENT DOCUMENTS

| | | |
|---|---|---|
| EP | 0776959 | 6/1997 |
| EP | A0776959 | 6/1997 |
| EP | 832171 | 1/2000 |
| EP | 1102827 | 9/2002 |
| EP | 1365005 | 11/2003 |
| EP | 1389635 | 2/2004 |
| EP | 1370633 | 8/2005 |
| EP | 1366134 | 11/2005 |
| GB | 713910 | 8/1954 |
| JP | 401133988 A | 5/1989 |
| WO | WO9410263 | 5/1994 |
| WO | WO9523765 | 9/1995 |
| WO | WO9603359 | 2/1996 |
| WO | WO9718278 | 5/1997 |
| WO | WO9721788 | 6/1997 |
| WO | WO9802503 | 1/1998 |
| WO | WO9920720 | 4/1999 |
| WO | 99/34917 | 7/1999 |
| WO | WO9934917 | 7/1999 |
| WO | 00/14179 | 3/2000 |
| WO | WO00/14184 | 3/2000 |
| WO | WO0014179 | 3/2000 |
| WO | WO0014183 | 3/2000 |
| WO | WO0014187 | 3/2000 |
| WO | WO0014188 | 3/2000 |
| WO | WO0015736 | 3/2000 |
| WO | WO0029511 | 5/2000 |
| WO | WO0107469 | 2/2001 |
| WO | WO0107538 | 2/2001 |
| WO | WO0118156 | 3/2001 |
| WO | WO0157166 | 8/2001 |
| WO | 01/74969 | 10/2001 |
| WO | WO0174969 | 10/2001 |
| WO | WO02064710 | 8/2002 |
| WO | WO02064711 | 8/2002 |
| WO | WO02070627 | 9/2002 |
| WO | WO02070629 | 9/2002 |
| WO | WO02070630 | 9/2002 |
| WO | WO02096842 | 12/2002 |

OTHER PUBLICATIONS

Lubricant Base Oil and Wax Processing, Azvilino Sequeira, Jr., Marcel Dekker, Inc., NY 1994, pp. 162-165.

International Search Report dated Oct. 29, 2003.

Senden, M.M.G., "The Shell Middle Distillate Synthesis Process:Commercial Plant Experience and Outlook into the Future".

Sie, S.T., et al. "Conversion of Natural Gas to Transportation Fuels via the Shell Middle Distillate Synthesis Process (SMDS)", Catalysis Today, Amsterdam, NL, vol. 8, 1991, pp. 371-394.

Peter J.A. Tijm, Shell Intl Gas Ltd., Alternative Energy 1995, "The Markets for Shell Middle Distillate Synthesis Products", Vancouver, Canada, May 2-4, 1995.

Fisher-Tropsch Waxes (LeRoux, Oranje) Part I, 1984.

Sasolwax H1 Certificate of Analysis, 2006.

Gas Chromatography Analysis of Sasolwax H1, 2006.

Letter dated Jun. 14, 2004 from Shell to EPO on EP 02726138.7.

Register extract for EP20020732741.0, 2001.

Dissertation of Glenda Webber, Sep. 2000. "Wax Characterisation by Instrumental Analysis", pp. 52-58.

M.M.G. Senden, "The Shell Middle Distillate Synthesis Process: Commercial plant experience and outlook into the future", Petrole et Techniques. Association Francaise Des Technic, Paris, Fr., No. 415, Jul. 1998, XP00)771962, pp. 94-97.

"Shell Middle Distillate Synthesis", Internet article, XP-002214343, 2003.

Sie, S. T. et al, "Conversion of Natural Gas to Transportation Fuels Via the Shell Middle Distillate Synthesis Process (SMDS)", Catalysis Today, vol. 8, 1991, pp. 371-394.

Avilino Sequeira, Jr., Marchel Dekker Inc. "Lubricant Base Oil and Wax Processing", New York 1994, pp. 162-165.

Peter J.A. Tijm, Shell Intl Gas Ltd. Alternative Energy 1995. "The Markets for Shell Middle Distillate Synthesis Products", Vancouver, Canada, May 2-4, 1995.

Shell MDS (Malaysia) "Manufacturing Clean Products From Natural Gas", May 1995.

ASTM D86—Standard Test Method for Distillation of Petroleum Products at Atmospheric Pressure, 2006.

ASTM D1160—Standard Method for Distillation of Petroleum Products at Reduced Pressure, 2002.

ASTM D2887 Standard Test Method for Boiling Range Distribution of Petroleum Fractions by Gas Chromatography, 2006.

Extract from the website http://www.schu.ac.uk. providing a description of the gas chromatography technique, 2006.

Introduction to Organic Laboratory Techniques, D L Pavia et al, 1976, pp. 614-625.

Letter from the Patentee to the EPO dated Jun. 14, 2004 in European Patent Application No. 02716826.9.

Extract from web-site http://www.deh.gov.au, providing a summary of the development of the European Union fuel standard through the years 1993 and 2000 (so-called "Euro-2" and "Euro-3" respectively) and beyond, for petrol (gasoline) and diesel fuel.

Lewis, Sr., Richard J.: Hawley's Condensed Chemical Dictionary, 14th Ed., John Wiley & Sons, New York, 2001 (p. 228).

Ballard, D. H., Generalizing the Hough Transformation to Detect Arbitrary Shapes. Pattern Recognition, vol. 13, No. 2, pp. 111-122, 1981.

Z. Liang & C. S. Hsu, "Molecular Speciation of Saturates by On-Line Liquid Chromatography-Field Ionization Mass Spectrometry", Energy & Fuel, Apr. 1998.

Kirk-Othmer Ency. of Chem. Tech., 3rd Ed., vol. 14, pp. 477-526, 2004.

Affidavit of John Rosenbaum dated Nov. 4, 2004, filed in connection with opposition proceedings on EP-B-1102827.

Opponent Shell submission in opposition proceedings against EP-B-1102827, letter dated Nov. 2, 2004, pp. 2 and 16-22.

1996 exchange of correspondence between Shell Malaysia and Yukong.

1996 sales invoice of waxy raffinate to Bentley Chemplax (Australia).

Bill from Showa Shell to General Sekiyu dated Jun. 12, 1997.

Affidavit of Mr. Masami Sakaguchi dated Jun. 17, 2004.

Internal Showa Shell note dated Dec. 17, 1996 re shipment of Process Oil 123X.

Sample Request Form for waxy raffinate Jul. 1996.

1993 Showa Shell brochure on XHVI.

Shell records relating to retained sample of commercial XHVI 5.2 base oil, 2006.

1996 exchange of correspondence between Chevron and Shell Malaysia.

R.M. Mortier & S.T. Orszulik, "Chemistry and Technology of Lubricants", 2nd Ed., pp. 4-5, 1997.

Affidavit of Susan Abernathy, filed in the Opposition to EP1368446, Jul. 25, 2006.

Affidavit of Dennis O'Rear, Apr. 2, 2007.

Lucie Coniglio and Armelle Nouviaire "A Method for Estimating the Normal Boiling Point of Heavy Hydrocarbons Suitable for a Group-Contribution-Based Equation of State", published in 2001 by the American Chemical Society, Incl. Eng. Chem. Res. 2001, 40, 1781-1790.

SAE Surface Vehicle Standard J300, Rev. Dec. 1999, J. Mass Spectrometry, vol. 31, 383-388 (1996), Klesper & Rollgen.

PROCESS TO PREPARE A MICROCRYSTALLINE WAX AND A MIDDLE DISTILLATE FUEL

PRIORITY CLAIM

The present application claims priority on European Patent Application 02077921.1 filed 18 Jul. 2002.

FIELD OF THE INVENTION

The invention is related to a process to prepare a Fischer-Tropsch derived microcrystalline wax.

A process route is disclosed for the preparation of Fischer-Tropsch derived microcrystalline wax products by the so-called Shell Middle Distillate Synthesis (SMDS) process is described in "The Markets for Shell Middle Distillate Synthesis Products", Presentation of Peter J. A. Tijm, Shell International Gas Ltd., Alternative Energy '95, Vancouver, Canada, May 2-4, 1995. This publication describes the preparation of various grades of wax products having congealing points ranging from 31 to 99° C. The disclosed process involves a Fischer-Tropsch synthesis step wherein a waxy product is obtained. This product is first hydrogenated and the hydrogenated product is separated by means of distillation into the various wax product grades. The product with the highest congealing point is referred to as SX100.

Said presentation also discloses a process to prepare middle distillates by hydrocracking/hydroisomerization of the Fischer-Tropsch synthesis product.

A disadvantage of the SX100 grade or similar commercial Fischer-Tropsch derived grades having a congealing point as determined by ASTM D 938 of between 85 and 120° C. is that they are too hard to be used in some applications. The hardness of a wax may be measured by the IP 376 method. Typical PEN values at 43° C. as obtained using this method on commercially available Fischer-Tropsch derived SX100 waxes are between 0.2 and 0.6 mm.

An almost similar process as the SMDS process disclosed in said presentation is disclosed in the recently published WO-A-0174969. In the disclosed process a Fischer-Tropsch product is subjected to a hydro-processing step at low conversion. The waxy products as obtained in the examples of said publication are characterized by means of a Needle Penetration Value according to ASTM D-1321. Because the temperature at which said value is measured is not provided no assessment of the softness of these products can be made. Furthermore a melting point is mentioned without providing a method on how this property was measured.

A disadvantage of the disclosed process in WO-A-0174969 or the disclosed SMDS process line-up is that a dedicated wax hydroconversion step is needed to prepare the wax products next to a dedicated middle distillate hydroconversion step to prepare middle distillates from a Fischer-Tropsch synthesis product.

SUMMARY OF THE INVENTION

The present invention provides a process to integrate the process of preparing soft waxes having a high congealing point with the production of middle distillate fuels having good cold flow properties.

The invention is directed to a process to prepare a microcrystalline wax and a middle distillate fuel by (a) hydrocracking/hydroisomerizing a Fischer-Tropsch product, wherein the product has a weight ratio of compounds having at least 60 or more carbon atoms and compounds having at least 30 carbon atoms of at least 0.4 and wherein at least 30 wt % of compounds in the Fischer-Tropsch product have at least 30 carbon atoms and wherein the conversion in step (a) is between 25 and 70 wt %, performing one or more distillate separations on the effluent of step (a) to obtain a middle distillate fuel fraction and a microcrystalline wax having an initial boiling point of between 500 and 600° C.

DETAILED DESCRIPTION OF THE INVENTION

Applicants found that by performing the hydrocracking/hydroisomerization step with the relatively heavy feedstock a process is obtained wherein in one hydrocracking step both middle distillates and a microcrystalline wax are obtained in a high yield. A further advantage of said process is that the fraction obtained boiling between said middle distillates and the microcrystalline wax is very suited as a lubricating base oil precursor. By dewaxing said fraction excellent quality base oils may be obtained.

The process of the present invention results in middle distillates having exceptionally good cold flow properties. These excellent cold flow properties could perhaps be explained by the relatively high ratio iso/normal and especially the relatively high amount of di- and/or trimethyl compounds. Nevertheless, the cetane number of the diesel fraction is more than excellent at values far exceeding 60, often values of 70 or more are obtained. In addition, the sulfur content is extremely low, always less than 50 ppmw, usually less than 5 ppmw and in most case the sulfur content is zero. Further, the density of especially the diesel fraction is less than 800 kg/m$^3$, in most cases a density is observed between 765 and 790 kg/m$^3$, usually around 780 kg/m$^3$ (the viscosity at 100° C. for such a sample being about 3.0 cSt). Aromatic compounds are virtually absent, i.e. less than 50 ppmw, resulting in very low particulate emissions. The polyaromatic content is even much lower than the aromatic content, usually less than 1 ppmw. T95, in combination with the above properties, is below 380° C., often below 350° C.

The process as described above results in middle distillates having extremely good cold flow properties. For instance, the cloud point of any diesel fraction is usually below −18° C., often even lower than −24° C. The CFPP is usually below −20° C., often −28° C. or lower. The pour point is usually below −18° C., often below −24° C.

The relatively heavy Fischer-Tropsch product used in step (a) has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}$+ fraction having an ASF-alpha value (Anderson-Schulz-Flory chain growth factor) of at least 0.925, preferably at least 0.935, more preferably at least 0.945, even more preferably at least 0.955.

The initial boiling point of the Fischer-Tropsch product may range up to 400° C., but is preferably below 200° C. Preferably any compounds having 4 or less carbon atoms and any compounds having a boiling point in that range are separated from a Fischer-Tropsch synthesis product before the Fischer-Tropsch synthesis product is used in step (a). In addition to the Fischer-Tropsch product other fractions may also be processed in step (a). Possible other fractions may suitably be any excess microcrystalline wax as obtained in step (b) or off-spec base oil fractions if base oils are also prepared in said process Such a Fischer-Tropsch product can be obtained by any process, which yields a relatively heavy Fischer-Tropsch product. Not all Fischer-Tropsch processes yield such a heavy product. An example of a suitable Fischer-Tropsch process is described in WO-A-9934917 and in AU-A-698392. These processes may yield a Fischer-Tropsch product as described above.

The Fischer-Tropsch product will contain no or very little sulfur and nitrogen containing compounds. This is typical for a product derived from a Fischer-Tropsch reaction, which uses synthesis gas containing almost no impurities. Sulphur and nitrogen levels will generally be below the detection limits, which are currently 5 ppm for sulfur and 1 ppm for nitrogen.

The Fischer-Tropsch product may optionally be subjected to a mild hydrotreatment step in order to remove any oxygenates and saturate any olefinic compounds present in the reaction product of the Fischer-Tropsch reaction. Such a hydrotreatment is described in EP-B-668342. The mildness of the hydrotreating step is preferably expressed in that the degree of conversion in this step is less than 20 wt % and more preferably less than 10 wt %. The conversion is here defined as the weight percentage of the feed boiling above 370° C., which reacts to a fraction boiling below 370° C. After such a mild hydrotreatment lower boiling compounds, having four or less carbon atoms and other compounds boiling in that range, will preferably be removed from the effluent before it is used in step (a).

The hydrocrackin/hydroisomerization reaction of step (a) is preferably performed in the presence of hydrogen and a catalyst, which catalyst can be chosen from those known to one skilled in the art as being suitable for this reaction. Catalysts for use in step (a) typically comprise an acidic functionality and a hydrogenation/dehydrogenation functionality. Preferred acidic functionalities are refractory metal oxide carriers. Suitable carrier materials include silica, alumina, silica-alumina, zirconia, titania and mixtures thereof Preferred carrier materials for inclusion in the catalyst for use in the process of this invention are silica, alumina and silica-alumina A particularly preferred catalyst comprises platinum supported on a silica-alumina carrier. If desired, applying a halogen moiety, in particular fluorine, or a phosphorous moiety to the carrier, may enhance the acidity of the catalyst carrier. Examples of suitable hydrocracking/hydroisomerization processes and suitable catalysts are described in WO-A-0014179, EP-A-532118, EP-A-666894 and the earlier referred to EP-A-776959.

Preferred hydrogenation/dehydrogenation functionalities s are Group VIII noble metals, for example palladium and more preferably platinum. The catalyst may comprise the hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder may be non-acidic. Examples are clays and other binders known to one skilled in the art.

In step (a) the feed is contacted with hydrogen in the presence of the catalyst at elevated temperature and pressure. The temperatures typically will be in the range of from 175° C. to 380° C., preferably higher than 250° C. and more preferably from 300° C. to 370° C. The pressure will typically be in the range of from 10 bar to 250 bar and preferably between 20 bar and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 70 wt %. The feed as used above in the definition is the total hydrocarbon feed fed to step (a), thus also any optional recycle to step (a).

In step (b) one or more distillate separations are performed on the effluent of step (a) to obtain at least one middle distillate fuel fraction and a micro-crystalline wax having an initial boiling point of between 500 and 600° C. Suitably more middle distillate fuel fractions are recovered from the effluent of step (a). Preferably at least two of the possible naphtha, kerosene or gas oil fractions are recovered from the product of step (a). Most preferably a gas oil fraction is isolated having the above described cold flow properties. This distillate separation is preferably performed by means of a distillation at about atmospheric conditions, preferably at a pressure of between 1.2-2 bara. The microcrystalline wax is preferably isolated from the bottom product as obtained in the atmospheric distillation by means of a distillation performed at near vacuum conditions. This atmospheric bottom product preferably boils for at least 95 wt % above 370° C. The vacuum distillation is suitably performed at a pressure of between 0.001 and 0.1 bara. The wax is preferably obtained as the bottom product of such a distillation. The distillate fractions as obtained in such a distillation may be recycled to step (a) or used to prepare lubricating base oils. This fraction may be further processed on site or sold as a waxy raffinate product. This product can be transported by for example ship or trains to base oil production facilities elsewhere. This (base oil precursor) fraction as obtained in said vacuum distillation preferably has a T10 wt % boiling point of between 200 and 450° C. and a T90 wt % boiling point of between 300, and preferably between 400 and 550° C.

The vacuum distillation of step (b) is preferably operated such that the desired congealing point of the microcrystalline wax is obtained.

The soft microcrystalline wax as obtained with the above process has preferably a congealing point as determined by ASTM D 938 of between 85 and 120 and more preferably between 95° C. and 120° C. and a PEN at 43° C. as determined by IP 376 of more than 0.8 mm and preferably more than 1 mm. The wax is further characterized in that it preferably comprises less than 1 wt % aromatic compounds and less than 10 wt% naphthenic compounds, more preferably less than 5 wt % naphthenic compounds. The mol percentage of branched paraffins in the wax is preferably above 33 mol % and more preferably above 45 mol % and below 80 mol % as determined by C13 NMR. This method determines an average molecular weight for the wax and subsequently determines the mol percentage of molecules having a methyl branch, the mol percentage of molecules having an ethyl branch, the mol percentage of molecules having a C3 branch and the mol percentage having a C4 branch, under the assumption that each molecule does not have more than one branch. The mol % of branched paraffins is the total of these individual percentages. This method calculated the mol % in the wax of an average molecule having only one branch. In reality, paraffin molecules having more than one branch may be present. Thus the content of branched paraffins determined by different methods may result in a different value.

The oil content as determined by ASTM D 721 is typically below 10 wt % and more preferably below 6 wt %. If lower oil contents are desired it may be advantageous to perform an additional de-oiling step. De-oiling processes are well known and are for example described in Lubricant Base Oil and Wax Processing, Avilino Sequeira, Jr, Marcel Dekker Inc., New York, 1994, pages 162-165. After de-oiling, the wax preferably has a oil content of between 0.1 and 2 wt %. The lower limit is not Critical. Values of above 0.5 wt % may be expected, but lower values can be achieved depending on the method in which the wax is obtained. Most likely the oil content will be between 1 and 2 wt %. The kinematic viscosity at 150° C. of the wax is preferably higher than 8 cSt and more preferably higher than 12 and lower than 18 cSt.

The invention will be illustrated with the following non-limiting examples.

EXAMPLE 1

The $C_5$-$C_{750}$° C.+ fraction of the Fischer-Tropsch product, as obtained in Example VII using the catalyst of Example III of WO-A-9934917 was continuously fed to a hydrocracking step (step (a)). The feed contained about 60 wt % $C_{30}$+ product. The ratio $C_{60}$+/$C_{30}$+ was about 0.55. In the hydrocracking step the fraction was contacted with a hydrocracking catalyst of Example 1 of EP-A-532118.

The effluent of step (a) was continuously distilled to give lights, fuels and a residue "R" boiling from 370° C. and above. The yield of gas oil fraction on fresh feed to hydrocracking step was 43 wt %. The properties of the gas oil as obtained are presented in Table 1. The main part of the residue "R" was recycled to step (a) and a remaining part was separated by means of a vacuum distillation into a microcrystalline wax having the properties as listed in Table 2. The fraction of microcrystalline wax obtained relative to the feed to the vacuum distillation was 63.2 wt %.

The conditions in the hydrocracking step (a) were: a fresh feed Weight Hourly Space Velocity (WHSV) of 1.02 kg/l.h, recycle feed WHSV of 0.31 kg/l.h, hydrogen gas rate=1000 Nl/kg, total pressure=40 bar, and a reactor temperature of 329° C.

TABLE 1

| Gas oil properties | |
|---|---|
| Cloud Point | −20 |
| CFPP | −21 |
| Pour Point | <−24 |
| Normals (wt %) | 21.3 |
| Iso's (wt %) | 78.7 |
| Mono-methyl | 39.5 |
| Di-methyl | 25.5 |
| Others | 13.8 |
| Density (kg/l) | 0.78 |
| Cetane (D976m) | 77 |
| Cetane (D4737m) | 85 |
| T95 | 360 |

TABLE 2

| | SX100* | Paraflint H1** | Product of Example 1 |
|---|---|---|---|
| Congealing point (ASTM D 938; ° C.) | 97.3 | 100 | 99 |
| Drop melting point (ASTM D 127) (° C.) | 110.0 | 113.5 | 112.3 |
| PEN at 25° C. (IP 376) (mm) | 0.1 | 0.1 | 11.4 |
| PEN at 43° C. | 0.4 | 0.4 | 17.6 |
| PEN at 65° C. | 1.1 | 1.7 | >20 |
| Oil content (ASTM D 721; wt %) | <0.1 | Not measured | 4.6 |
| Kinematic viscosity at 150° C. (ASTM D 445) | 7.97 | Not measured | 13.9 |
| Micro-crystalline structure by microscopic observation | Yes | Yes | Yes |

*SX100 is a Fischer-Tropsch wax as marketed by Shell Malaysia bhp
**Paraflint H1 is a Fischer-Tropsch derived wax marketed by Schumann Sasol

I claim:

1. A Process to prepare a microcrystalline wax and a middle distillate fuel by (a) hydrocracking/hydroisomerizing a Fischer-Tropsch product, wherein the product has a weight ratio of compounds having at least 60 or more carbon atoms and compounds having at least 30 carbon atoms of at least 0.4 and wherein at least 30 wt % of compounds in the Fischer-Tropsch product have at least 30 carbon atoms and wherein the conversion in step (a) is between 25 and 70 wt %, (b) performing one or more distillate separations on the effluent of step (a) to obtain a middle distillate fuel fraction and a microcrystalline wax having an initial boiling point of between 500° C. and 600° C.

2. The process of according to claim 1, wherein at least 50 wt % of compounds in the Fischer-Tropsch product have at least 30 carbon atoms.

3. The process of claim 1, wherein the microcrystalline wax as obtained has a congealing point of between 95-120° C. and a PEN at 43° C. as determined by IP 376 of more than 0.8 mm.

4. The process of claim 3, wherein the PEN at 43° C. is more than 1.0 mm.

5. The process of claim 1, wherein the wax obtained in step (b) is subjected to an additional de-oiling step to obtain a wax having an oil content of between 0.1 and 2 wt %.

6. The process of claim 2, wherein the microcrystalline wax as obtained has a congealing point of between 95-120° C. and a PEN at 43° C. as determined by IP 376 of more than 0.8 mm.

7. The process of claim 2, wherein the wax obtained in step (b) is subjected to an additional de-oiling step to obtain a wax having an oil content of between 0.1 and 2 wt %.

8. The process of claim 3, wherein the wax obtained in step (b) is subjected to an additional de-oiling step to obtain a wax having an oil content of between 0.1 and 2 wt %.

9. The process of claim 4, wherein the wax obtained in step (b) is subjected to an additional de-oiling step to obtain a wax having an oil content of between 0.1 and 2 wt %.

* * * * *